US005573144A

United States Patent [19]

Steib, Jr. et al.

[11] Patent Number: 5,573,144

[45] Date of Patent: Nov. 12, 1996

[54] SOAP SAVING DEVICE

[76] Inventors: Sidney J. Steib, Jr.; Gayle A. Steib, both of P.O. Box 920, Garyville, La. 70051

[21] Appl. No.: 437,812

[22] Filed: May 9, 1995

[51] Int. Cl.[6] ..... B65D 37/00

[52] U.S. Cl. ..... 22/189.08; 222/189.06; 222/215; 222/190

[58] Field of Search ..... 222/189.06, 189.07, 222/189.08, 189.11, 206, 212, 215, 190

[56] References Cited

U.S. PATENT DOCUMENTS

| | | | |
|---|---|---|---|
| 2,014,236 | 9/1935 | McNamara | 222/215 X |
| 2,193,897 | 3/1940 | Bobrick | 222/190 X |
| 2,207,834 | 7/1940 | Stern | 222/215 X |
| 2,477,998 | 8/1949 | McCowan | 222/190 X |
| 2,500,639 | 3/1950 | Lermer | 222/215 |
| 2,578,907 | 12/1951 | Tupper | 222/215 X |
| 2,589,415 | 3/1952 | Meshberg | 222/189 |
| 3,926,348 | 12/1975 | Lutzker | 222/189 |
| 4,555,046 | 11/1985 | Bennett | 222/189 |
| 4,928,857 | 5/1990 | Ecker | 222/190 X |
| 5,030,405 | 7/1991 | Smith et al. | 264/219 |
| 5,409,145 | 4/1995 | Payne | 222/212 |

*Primary Examiner*—Andres Kashnikow
*Assistant Examiner*—Kenneth Bomberg
*Attorney, Agent, or Firm*—Joseph N. Breaux

[57] ABSTRACT

A soap saving device including a substantially water tight container member having a chamber in fluid communication with a Sealable spout. The spout has a first screen placed thereacross to prevent particles of soap from exiting through the spout. The chamber is divided by a second screen into a soap holding chamber and a water holding chamber. The soap holding chamber is positioned adjacent the spout and is of a size sufficient to receive therein a bar of soap which may be placed into the soap holding chamber through an opening provided in the container for such purpose. The screen apertures of the second screen are preferably sized in a manner to prevent passage of spherical objects therethrough that have a radius greater than two-tenths of an inch. The screen apertures of the first screen are preferably sized in a manner to prevent passage of spherical objects therethrough having a radius greater than one-tenth of an inch.

10 Claims, 3 Drawing Sheets

SOAP SAVING DEVICE

DESCRIPTION

1. Technical Field

The present invention relates to devices utilized for conserving bar soap and more particularly to devices utilized for conserving bar soap that conserve soap by converting bar soap into a liquid form.

2. Background Art

Bathing and showering is generally accomplished using a wash cloth and a bar of soap. These soap bars start out as a hand sized bar but through use and exposure to water become progressively smaller and eventually become difficult to manage. Once the soap bar has become too small to be easily handled, it is often discarded. It would be a benefit, therefore, to have a device which minimized exposure of the soap bar to water during bathing and showering. It would be a further benefit to have a device that allowed even small slivers of soap to be conveniently used for bathing and showering.

GENERAL SUMMARY DISCUSSION OF INVENTION

It is thus an object of the invention to provide a soap saving device that minimizes exposure of the soap bar to water during showering and bathing.

It is a further object of the invention to provide a soap saving device that allows slivers of soap that are too small to easily handle to be conveniently utilized for bathing and showering.

Accordingly, a soap saving device is provided. The soap saving device includes a substantially water tight container member having a chamber in fluid communication with a sealable spout. The spout has a first screen placed thereacross to prevent particles of soap from exiting through the spout. The chamber is divided by a second screen into a soap holding chamber and a water holding chamber. The soap holding chamber is positioned adjacent the spout and is of a size sufficient to receive therein a bar of soap which may be placed within the soap holding chamber through an opening provided in the container for such purpose.

The screen apertures of the second screen are preferably sized in a manner to prevent passage of spherical objects therethrough that have a radius greater than two-tenths of an inch. The screen apertures of the first screen are preferably sized in a manner to prevent passage of spherical objects therethrough having a radius greater than one-tenth of an inch.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein.

EXEMPLARY MODE FOR CARRYING OUT THE INVENTION

Figure 1:
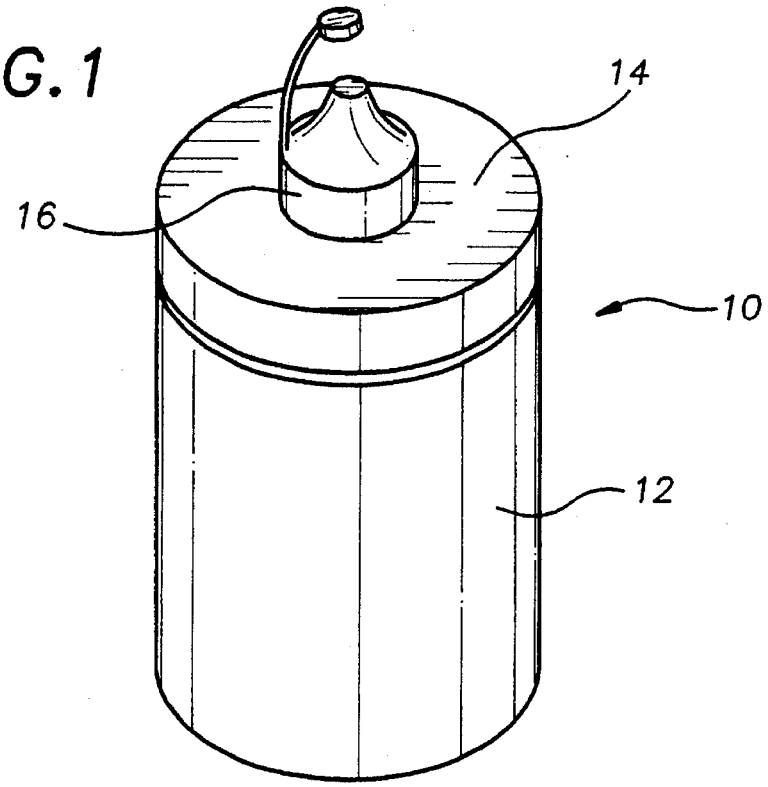
FIG. 1 is a perspective view of an exemplary embodiment of the soap saving device of the present invention.

FIG. 1 shows an exemplary embodiment of the soap saving device of the present invention, generally designated by the numeral 10. Soap saving device 10 includes a squeezable plastic container member 12, a cap member 14 is securable over the opening of container member 12, a sealable spout member 16 threadedly secured to an opening in cap member 14, (now with reference to FIG. 2) a first screen 18, and a second screen 20.

Figure 2:
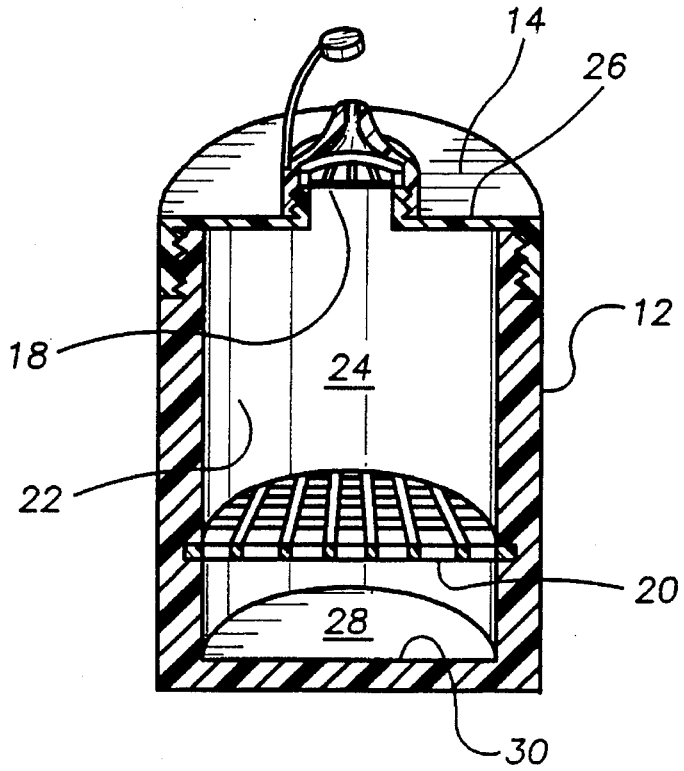
FIG. 2 is a cross-sectional, perspective view of the soap saving device of FIG. 1 illustrating the soap holding chamber created between the first and second screens.

As shown in FIG. 2, first screen 18, second screen 20 and a portion of the interior wall 22 of container member 12 form a cylindrically shaped soap holding chamber 24 for containing up to a full bar of soap during use. Soap holding chamber 24 has a diameter of about three and one-half (3½") inches and a height from second screen 20 to the interior roof 26 of cap member 14 of about six (6") inches. A cylindrically shaped, water chamber 28 is formed between second screen 20 and the interior bottom 30 of container member 12 for storing excess water run-off from the soap bar when soap saving device 10 is not in use. Water chamber 28 has a diameter of about three and one-half (3½") inches and a height from second screen 20 to the interior bottom 30 of container member 12 of about two (2") inches.

Figure 2A:
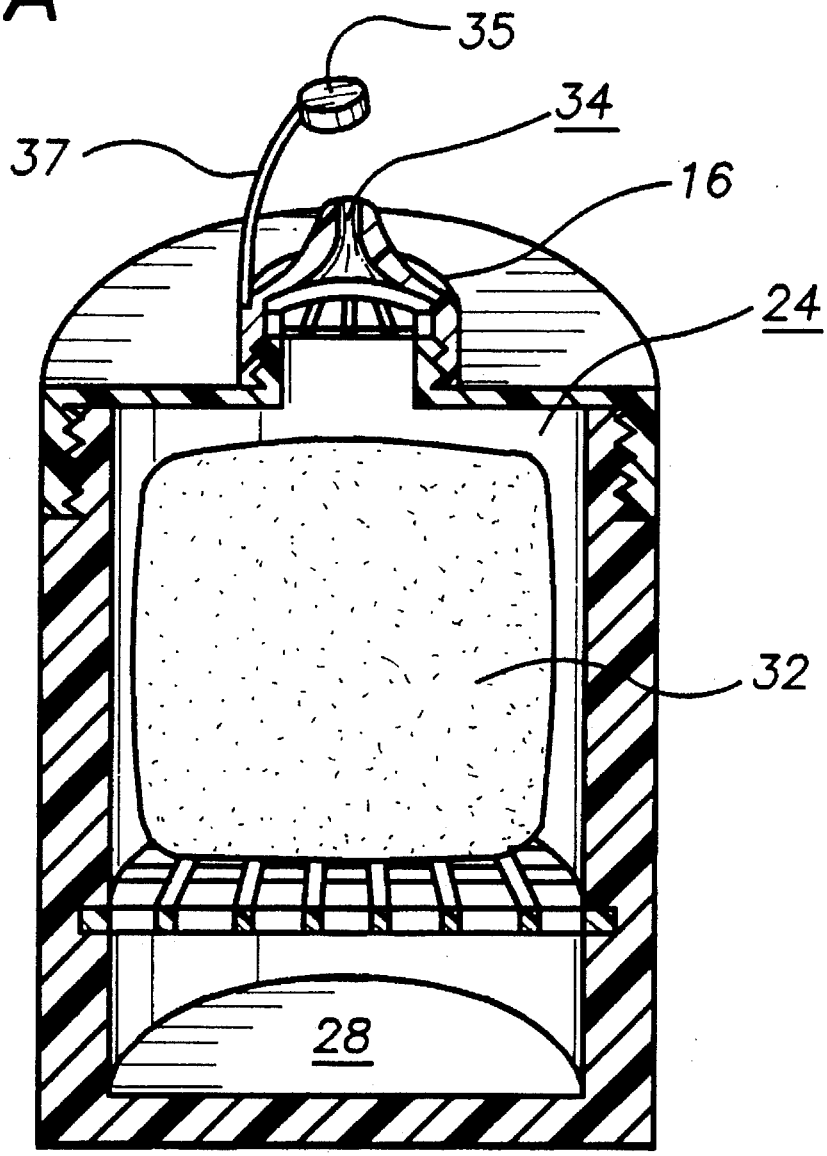
FIG. 2A is a cross-sectional, perspective view of the soap saving device of FIG. 1 illustrating a representative bar of soap disposed within the soap holding chamber created between the first and second screens.

FIG. 2A is a cross-sectional, perspective view of soap saving device 10 illustrating a representative bar of soap 32 disposed within soap holding chamber 24. It can be seen from the figure that water may freely move between soap holding chamber 24, water chamber 28, and out through a spout orifice 34 formed in spout member 16. Spout orifice 34 is sealable with an orifice cap 35 that is secured to spout member 16 with an elongated flexible member 37.

Figure 3:
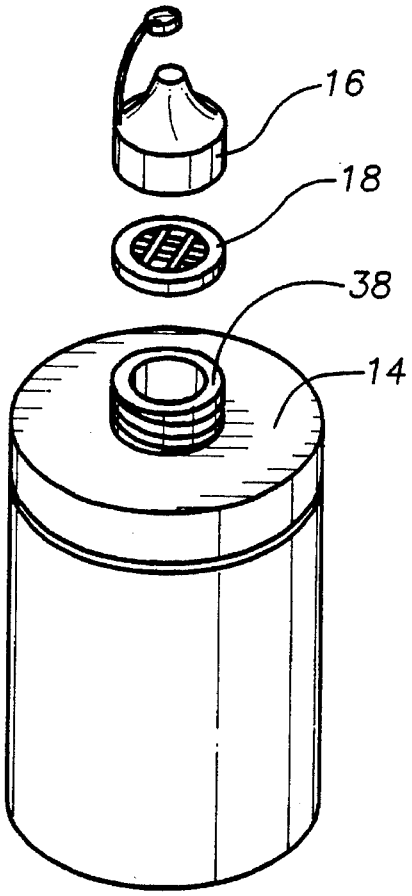
FIG. 3 is a partially exploded view of the soap saving device of FIG. 1 illustrating installation of the first screen between the sealable spout and the threaded fitting of the cap member.

FIG. 3 is a partially exploded view of soap saving device 10 illustrating installation of first screen 18 between sealable spout member 16 and a threaded fitting 38 centrally located on cap member 14. First screen 18 includes a plurality of approximately one-tenth (1/10") inch across apertures 19. This aperture size insures that small soap particles remain within soap saving device 10 until dissolved.

Figure 4:
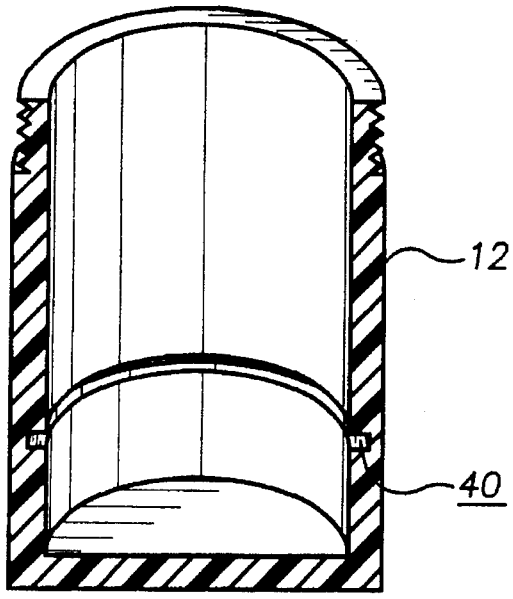
FIG. 4 is a cut-away perspective view of the container member illustrating the annular screen receiving channel.

FIG. 4 is a cut-away perspective view of container member 12 illustrating an annular second screen receiving channel 40 within which a perimeter portion 42 of second screen 20 (shown in FIG. 5) is disposed during assembly.

Figure 5:
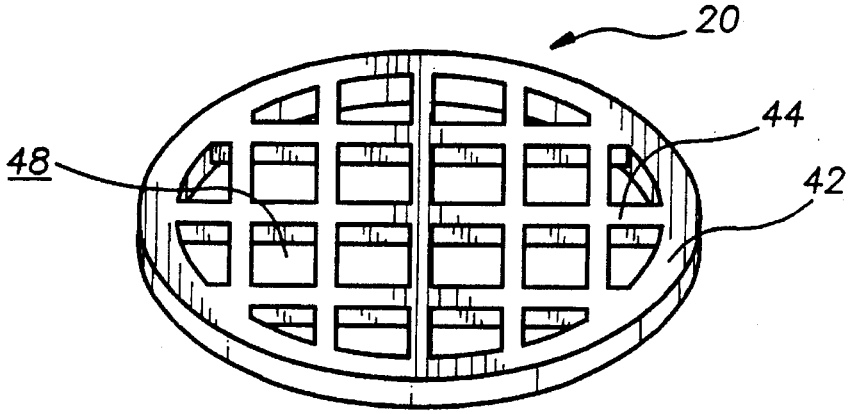
FIG. 5 is a perspective view of the second screen.

FIG. 5 is a perspective view of second screen 20 showing perimeter portion 42 surrounding a plurality of screening members 44. Screen members 44 intersect to form a plurality of approximately one-eighth (1/8") inch apertures 48.

Use of soap saving device 10 is now described with general reference to FIGS. 1–5. A bar of soap 32 is placed into the soap holding chamber by unscrewing cap member 14 from container member 12. Cap member 14 is then replaced. A quantity of water is then placed into container member 12 through spout orifice 34. Orifice cap 35 is then placed over spout orifice 34 and soap saving device 10 vigorously shaken to develop a soapy liquid. The soapy liquid is then dispensed through spout orifice 34 onto a washcloth during showering and bathing. When finished, spout orifice 34 may be capped with orifice cap 35 and soap saving device 10 stored on a rack or shelf. Since bar of soap 32 is supported above the water in water chamber 28 excess water remaining on the soap drains off bar of soap 32 into water chamber 28. It can be appreciated from the preceding description that a decrease in the size of bar of soap 32 has no effect on the operation of soap saving device 10 until the soap particles reach a size small enough to pass through apertures 48 of second screen 20. Because apertures 48 are dimensioned larger than apertures 19, when the soap particles reach a small enough size they pass through second screen 20 into water chamber 28 where they become fully dissolved and may be dispensed in a liquid form during the next shower or bath.

It can be seen from the preceding description that a soap saving device that minimizes exposure of the soap bar to water during showering and bathing, and that allows slivers of soap that are too small to easily handle to be conveniently utilized for bathing and showering has been provided.

It is noted that the embodiment of the soap saving device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A soap saving device comprising:

a container member having an interior sidewall defining a first chamber within said container member, said first chamber being accessible through a container opening at a top portion of said container member, said container opening being of a size sufficient to allow a bar of soap to be inserted therethrough into said first chamber, said interior sidewall having an annular channel formed circumferentially therearound spaced a distance of at least two inches from said container opening, said first chamber being of a size between said container opening and said annular channel sufficient to receive therein the bar of soap;

a cap member sealingly securable over said container opening in a manner to retain the bar of soap and a quantity of fluid within said first chamber when said cap member is sealingly secured and said container member is shaken, said cap member having a centrally located, threaded fitting having a lip defining a dispensing aperture therethrough, said dispensing aperture being in fluid communication with said first chamber;

a first screen member positioned over said dispensing aperture and having a plurality of first screen apertures therethrough, said first screen member having an area sufficient to cover said dispensing aperture;

a spout member having an internally threaded connecting end companionately threaded to mate with said threaded fitting, said spout member further including a fluid pathway therethrough in fluid communication at one end thereof with said connecting end and fluid communication with a second end thereof with a spout orifice open to an exterior of said soap saving device;

a spout orifice sealing member securable over said spout orifice in a manner to seal said spout orifice from the passage of fluid therethrough; and a second screen member having a plurality of second screen apertures formed therethrough and including a perimeter portion sized and dimensioned to allow said perimeter portion to be captively held within said annular channel in a manner such that said second screen member divides said first chamber into a soap holding chamber and a water holding chamber, said perimeter portion of said second screen member being captively disposed within said annular channel, said second screen apertures being sized in a manner to prevent passage of spherical objects therethrough that have a radius greater than two-tenths of an inch.

2. The soap saving device of claim 1, wherein:

said container member is constructed from a resilient plastic.

3. The soap saving device of claim 1, wherein:

said first screen apertures are sized in a manner to prevent passage of spherical objects therethrough that have a radius greater than one-tenth of an inch.

4. The soap .saving device of claim 1 wherein:

said first and second screen members are constructed from plastic.

5. The soap saving device of claim 1 wherein:

said annular channel is spaced from said container opening by a distance greater than three inches.

6. The soap saving device of claim 1 wherein:

said first chamber includes a bottom surface defining a bottom of said first chamber; and said anular channel is spaced from said bottom surface by a distance greater than one inch.

7. The soap saving device of claim 1, wherein:

said container member is constructed from a resilient plastic; and said annular channel is spaced from said container opening by a distance greater than three inches.

8. The soap saving device of claim 7 wherein:

said first chamber includes a bottom surface defining a bottom of said first chamber; and said anular channel is spaced from said bottom surface by a distance greater than one inch.

9. The soap saving device of claim 8 wherein:

said first screen apertures are sized in a manner to prevent passage of a spherical objects therethrough that have a radius greater than one-tenth of an inch.

10. The soap saving device of claim 9 wherein:

said first and second screen members are constructed from plastic.

* * * * *